US007441742B2

(12) United States Patent
Kwon et al.

(10) Patent No.: US 7,441,742 B2
(45) Date of Patent: Oct. 28, 2008

(54) HORIZON CONTROL STRUCTURE FOR WASHING MACHINE

(75) Inventors: Ho Cheol Kwon, Changwon-si (KR); Il Hyeok Yim, Goyang-si (KR); Youn Su Jung, Changwon-si (KR); Hack Jai Song, Changwon-si (KR); Beom Jun Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/567,962

(22) PCT Filed: May 25, 2005

(86) PCT No.: PCT/KR2005/001534

§ 371 (c)(1),
(2), (4) Date: Feb. 10, 2006

(87) PCT Pub. No.: WO2005/118941

PCT Pub. Date: Dec. 15, 2005

(65) Prior Publication Data

US 2006/0231726 A1 Oct. 19, 2006

(30) Foreign Application Priority Data

Jun. 1, 2004 (KR) ..... 10-2004-0039501

(51) Int. Cl.
*F16M 1/00* (2006.01)

(52) U.S. Cl. ..... 248/677; 248/188.2

(58) Field of Classification Search ..... 248/677, 248/188.2, 188.3, 188.4, 188.8, 188.9; 34/108
See application file for complete search history.

(56) References Cited

U.S. PATENT DOCUMENTS

| | | | | | |
|---|---|---|---|---|---|
| RE20,925 | E | * | 11/1938 | Rees | 248/188.2 |
| 2,366,867 | A | * | 1/1945 | Nichthauser | 248/188.2 |
| 2,893,164 | A | * | 7/1959 | Martin | 248/188.2 |
| 4,073,454 | A | * | 2/1978 | Sauber | 248/188.2 |
| 4,462,225 | A | | 7/1984 | Noe | |
| 6,484,437 | B2 | * | 11/2002 | Roberts | 43/109 |
| 6,536,725 | B2 | * | 3/2003 | Fisher | 248/188.4 |
| 6,540,190 | B2 | * | 4/2003 | Keshavjee | 248/346.11 |
| 2002/0109054 | A1 | * | 8/2002 | Burr | 248/188.4 |

(Continued)

FOREIGN PATENT DOCUMENTS

JP 55-13540 U 1/1980

(Continued)

*Primary Examiner*—Ramon O Ramirez
(74) *Attorney, Agent, or Firm*—Birch, Stewart, Kolasch & Birch, LLP

(57) ABSTRACT

A horizon control structure for a washing machine is provided. The structure includes: a stopper base having a base body having a predetermined diameter, a sleeve mount hollow depressed inside of the base body and having a predetermined diameter, at least one protrusion insertion through-hole being at a distance and provided inside of the base body, and a slip preventing part provided on a bottom surface of the base body; and a leg stopper layered on the stopper base, and having a stopper body having a predetermined diameter, an insertion sleeve extended from a rear surface of the stopper body and having a predetermined diameter and length, and an insertion protrusion protruded from a rear surface of the stopper body and having a predetermined length.

14 Claims, 3 Drawing Sheets

U.S. PATENT DOCUMENTS

2006/0021391 A1* 2/2006 Yim et al. ..... 68/3 R
2006/0131466 A1* 6/2006 Cha et al. ..... 248/188.8

FOREIGN PATENT DOCUMENTS

JP 61-170496 U 10/1986
JP 02-72298 A 3/1990
KR 2000-20040 A 4/2000
KR 2003-0073850 A 9/2003

* cited by examiner

[Fig. 1]
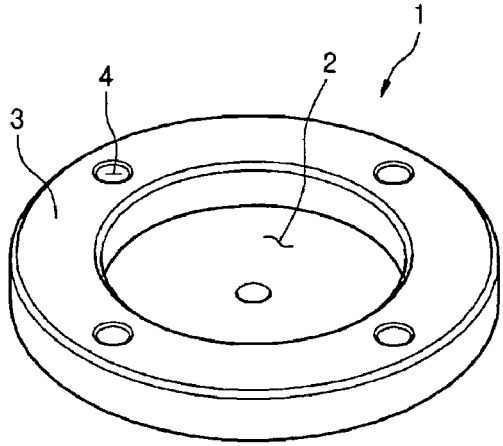
[Fig. 2]
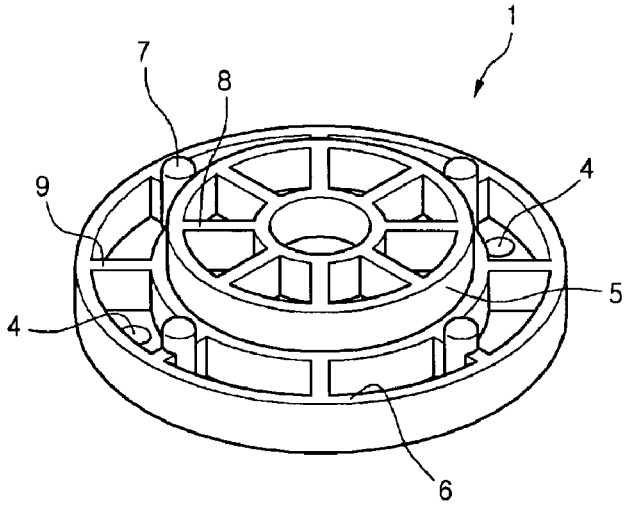
[Fig. 3]
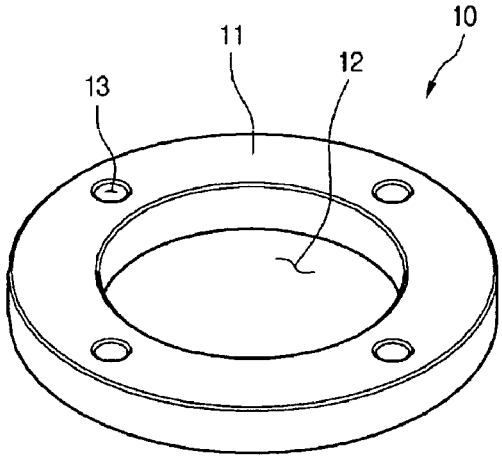

[Fig. 4]
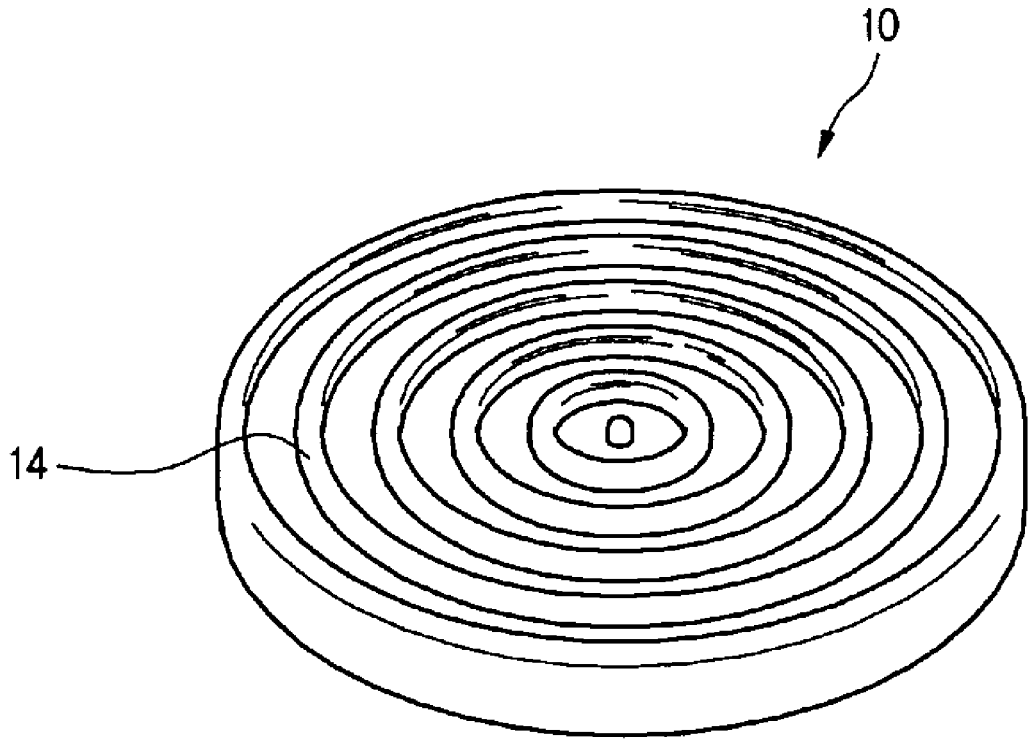

[Fig. 5]
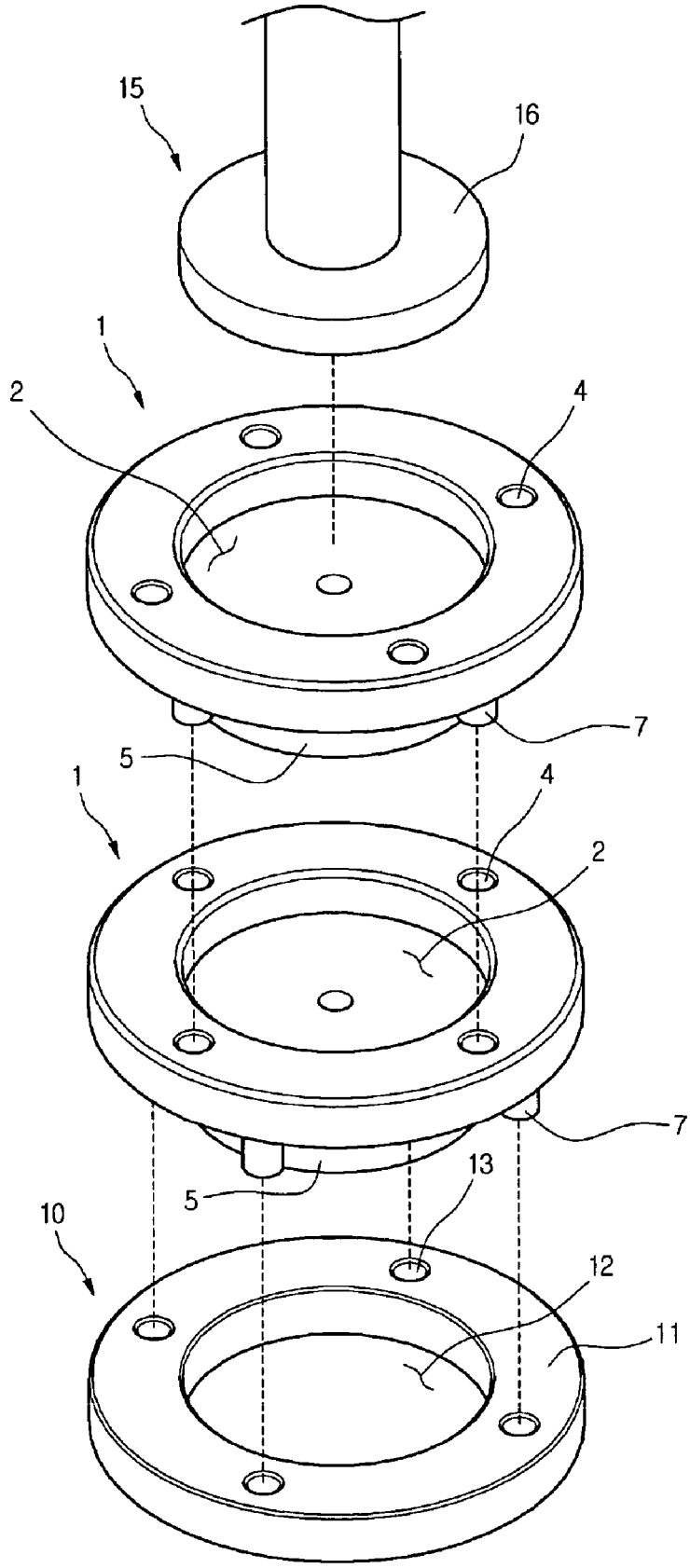

HORIZON CONTROL STRUCTURE FOR WASHING MACHINE

BACKGROUND OF THE INVENTION

1. Field of the Invention

The present invention relates to a washing machine, and more particularly, to a horizon control structure for a washing machine in which the washing machine is always maintained in a horizontal state even when it is installed at a place where a bottom is not in the horizontal state.

2. Description of the Related Art

In general, a washing machine is a household appliance for eliminating contaminants from clothes using a collision reaction of laundry and washing water and a surface active reaction of detergent. In the washing machine, wash, rinse, dehydration and/or dry are/is performed using an electric motor as a main power source.

The washing machine is classified into a cylinder type washing machine, an agitator type washing machine and a pulsator type washing machine depending on a washing method.

In a detailed description, the cylinder type washing machine has a plurality of lifts within a drum. The lift raises and drops the laundry in the drum when the drum is rotated at a low speed centering on a horizontal axis. At this time, impact is generated between the laundry and the washing water, thereby performing wash.

In the agitator type washing machine, a wing-shaped agitator is protruded from a center of a drum tub, and is rotated to the right and left to perform the wash.

In the pulsator type washing machine, a distal shaped pulsator is rotated to generate the flow of water, thereby performing the wash.

A conventional washing machine is disclosed in a Korean Patent Application No. 10-2002-0013602 and therefore, its detailed description for a construction and an operation will be omitted.

The conventional washing machine has a leg mounted at a lower side. The leg is rotated to always maintain the washing machine in a horizontal state even at a place where a bottom is uneven or sloped.

However, when the conventional washing machine is installed on a heavily sloped bottom or a rugged bottom, it has limitation in that due to limited length of the leg, horizon cannot be controlled using only rotation of the leg at a heavily sloped place.

In other words, due to the above limitations, when the washing machine is installed at the heavily sloped place, a separate member such as a brick or a wood fragment is provided at a lower side of the leg, thereby adjusting the washing machine in height.

However, the separate member is not constructed integrally with a washing machine body and the leg. Accordingly, the conventional washing machine has a drawback in that a walking phenomenon of shaking the washing machine is caused by vibration, which is generated and not absorbed when the washing machine is activated.

SUMMARY OF THE INVENTION

Accordingly, the present invention is directed to a horizon control structure for a washing machine that substantially obviates one or more of the problems due to limitations and disadvantages of the related art.

An object of the present invention is to provide a horizon control structure for a washing machine in which the washing machine can be always maintained in a horizontal state even when being installed at a place where a bottom is not in the horizontal state or is not smooth.

Another object of the present invention is to provide a horizon control structure for a washing machine in which a user is allowed to directly adjust and set a horizontal state of the washing machine, thereby reducing a cost resulting from a separate service request.

To achieve these and other advantages and in accordance with the purpose of the present invention, as embodied and broadly described, there is provided a horizon control structure for a washing machine, the structure including: a leg; at least one leg stopper disposed at a lower side of the leg; and a stopper base disposed at a lower side of the leg or the leg stopper.

In another aspect of the present invention, there is provided a horizon control structure for a washing machine, the structure including: a stopper base having a base body having a predetermined diameter, a sleeve mount hollow depressed inside of the base body and having a predetermined diameter, at least one protrusion insertion through-hole being at a distance and provided inside of the base body, and a slip preventing part provided on a bottom surface of the base body; and a leg stopper layered on the stopper base, and having a stopper body having a predetermined diameter, an insertion sleeve extended from a rear surface of the stopper body and having a predetermined diameter and length, and an insertion protrusion protruded from a rear surface of the stopper body and having a predetermined length.

According to the present invention, there is an effect in that a washing machine is always maintained even at a place where a bottom is sloped and rugged.

Further, the present invention has an effect in that a user can directly adjust horizon of a washing machine without a separate service request, thereby reducing a cost of service.

BRIEF DESCRIPTION OF THE DRAWINGS

FIG. 1 is a plan and perspective view illustrating a leg stopper of a washing machine according to the present invention;

FIG. 2 is a rear and perspective view illustrating the leg stopper of FIG. 1;

FIG. 3 is a plan and perspective view illustrating a stopper base for adjusting horizon of a washing machine according to the present invention;

FIG. 4 is a rear and perspective view illustrating the stopper base of FIG. 3; and FIG. 5 is a disassembled perspective view illustrating a state where a leg stopper of a washing machine is assembled according to the present invention.

DESCRIPTION OF THE INVENTION

Hereinafter, preferred embodiments of the present invention will be described in detail with reference to accompanying drawings.

FIG. 1 is a plan and perspective view illustrating a leg stopper of a washing machine according to the present invention, and FIG. 2 is a rear and perspective view illustrating the leg stopper of FIG. 1.

Referring to FIGS. 1 and 2, the leg stopper 1 includes a stopper body 3 having a pre-determined diameter; and a sleeve mount hollow 2 depressed inside of the stopper body 1 and having a predetermined diameter and depth.

The leg stopper 1 further includes at least one protrusion insertion through-hole 4 being at a distance on the stopper body 3; a mount sleeve 5 extended from a rear surface of the sleeve mount hollow 2 and having a predetermined diameter and depth; and a coupling protrusion 7 protruded from a rear surface of the stopper body 3 and having a predetermined length, and inserted into the protrusion insertion through-hole 4.

In a detailed description, the stopper body 3 can be formed to have a predetermined thickness, but is formed to have a hollow part and a plurality of radial outer ribs 9 on its rear surface, thereby preventing a swelling phenomenon or a twisting phenomenon in a process of cooling a high temperature resin when the leg stopper 1 is injection molded. Accordingly, there is an effect in that the stopper body 3 is totally reduced in thickness and instead, the outer rib 9 prevents contraction and reinforces strength in injection molding.

Meantime, the mount sleeve 5 is provided on a rear surface of the sleeve mount hollow 2, and is extended to have the almost same diameter as the sleeve mount hollow 2. A plurality of inner ribs 8 are also provided inside of the mount sleeve 5 to have a hollow part and a radial shape as the stopper body 3 does. The outer rib 9 and the inner rib 8 are disposed on the same line passing a center of the leg stopper 1, thereby preventing the leg stopper 3 from being destroyed by stress concentration. The mount sleeve 5 is more extended from the rear surface of the stopper body 3 to have a pre-determined length, and is inserted into and mounted on a sleeve mount hollow 2 provided on an upper surface of another leg stopper 1. A mount surface 6 is ranged from a rim portion of the mount sleeve 5 to a circumference portion of the stopper body 3, and is in contact with an upper surface of the stopper body 3.

The coupling protrusion 7 can be formed in plural on the rear surface of the stopper body 3, and is preferably formed integrally with a center of the outer rib 9. In other words, if the coupling protrusion 7 itself is protruded from the rear surface of the stopper body 3, it is in danger of being broken by external force. However, if the coupling protrusion 7 is formed integrally with the center of the outer rib 9, it is reinforced in strength by the outer rib 9. For coupling convenience, the coupling protrusion 7 is preferably formed at an inter-symmetric position. The coupling protrusion can be also formed integrally with the inner rib 8.

The protrusion insertion through-hole 4 is spaced apart from the coupling protrusion 7 to insert the coupling protrusion 7. In other words, the protrusion insertion through-hole 4 is provided at the hollow part, which is disposed between the outer ribs 9, and passes through the stopper body 3.

Preferably, the leg stopper 1 is injection molded using plastic to facilitate manufacture and reduce a cost of manufacture.

FIG. 3 is a plan and perspective view illustrating a stopper base for adjusting horizon of the washing machine according to the present invention, and FIG. 4 is a rear and perspective view illustrating the stopper base of FIG. 3.

Referring to FIGS. 3 and 4, the stopper base 10 includes a base body 11 formed to have a predetermined diameter, a sleeve mount hollow 12 depressed inside of the base body 11 and having a predetermined diameter and depth; and at least one protrusion insertion through-hole 13 being at a distance on the base body 11 and inserting the coupling protrusion 7. In a detailed description, the protrusion insertion through-hole 13 is preferably disposed at the inter-symmetric position to be effectively coupled with the coupling protrusion 7 as aforementioned in the description for the leg stopper 1.

The stopper base 10 includes at lease one slip preventing parts 14 concentrically formed on its rear surface. In a detailed description, the slip preventing part 14 prevents the stopper base 10 from slipping in direct contact with a bottom surface when the stopper base 10 supports the washing machine in contact with the bottom surface.

Since the stopper base 10 is in direct contact with the bottom surface, it should absorb vibration generated when the washing machine is activated, and prevent the washing machine from slipping on the bottom surface. Accordingly, the stopper base 10 is preferably formed of rubber. In a detailed description, the stopper base 10 can be formed of butyl synthetic rubber.

The stopper base 10 is preferably formed to have the almost same diameter as the leg stopper 1, thereby providing neat appearance and effectively coupling with the leg stopper 1.

FIG. 5 is a disassembled perspective view illustrating a state where the leg stopper of the washing machine is assembled according to the present invention.

In FIG. 5, the leg stopper 1 and the stopper base 10 described in FIGS. 1 to 4 are duplicate and accordingly, their descriptions will be omitted.

Nondescribed parts of FIG. 5 are a leg 15 of the washing machine, and a leg mount part 16 provided at a lower side of the leg 15 and mounted on the sleeve mount hollow 2.

Referring to FIG. 5, the leg mount part 16 has a size of being mounted on the sleeve mount hollow 2, and the coupling protrusion 7 is inserted into the protrusion insertion through-holes 4 and 13. The mount sleeve 5 is inserted into and mounted on the sleeve mount hollows 2 and 12.

When the washing machine is installed on a sloped bottom or a rugged bottom, an appropriate number of the leg stoppers 1 can be layered on the stopper base 10 depending on a gradient of the bottom and the like.

In a detailed description, the leg stopper 1 layered on the stopper base 10 is controlled in number, thereby maintaining the washing machine in the horizontal state. In other words, when the bottom is smoothly sloped, only the stopper base 10 can be used. On the contrary, when the bottom is abruptly sloped, the stopper base 10 and the appropriate number of the leg stoppers 1 can be used.

Meantime, in the inventive horizon control structure for the washing machine, it is desirable that the stopper base 10 is essentially used to absorb the vibration and prevent the slip. It is desirable that the leg stopper 1 is layered as much of the number as needed for height adjustment, thereby allowing the washing machine to be in the horizontal state.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

In a horizon control structure for a washing machine according to the present invention, even when the washing machine is installed at a place where a bottom is sloped and rugged, its horizontal state can be easily controlled and therefore, an industrial applicability is greatly enhanced.

The invention claimed is:

1. A horizon control structure for a washing machine, the structure comprising:

a stopper base having a base body having a predetermined diameter, a sleeve mount hollow depressed inside of the base body and having a predetermined diameter, and at least one protrusion insertion through-hole being at a distance and provided inside of the base body;

a leg stopper layered on the stopper base, and having a stopper body having a predetermined diameter, an insertion sleeve extended from a rear surface of the stopper body and having a predetermined diameter and length, and an insertion protrusion protruded from a rear surface of the stopper body and having a predetermined length; and a leg layered on the leg stopper.

2. The structure according to claim 1, wherein the leg stopper comprises at least one radial reinforcing rib on its rear surface.

3. The structure according to claim 1, wherein the leg stopper comprises at least one coupling protrusion protruded from its rear surface to have a predetermined length.

4. The structure according to claim 1, wherein the leg stopper is formed of plastic.

5. The structure according to claim 1, wherein the leg stopper is formed by injection molding.

6. The structure according to claim 1, wherein the stopper base is formed of rubber.

7. The structure according to claim 1, wherein the stopper base is formed of butyl synthetic rubber.

8. A horizon control structure for a washing machine, the structure comprising:

a stopper base having a base body having a predetermined diameter, a sleeve mount hollow depressed inside of the base body and having a predetermined diameter, at least one protrusion insertion through-hole being at a distance and provided inside of the base body and a slip preventing part provided on a bottom surface of the base body; and a leg stopper layered on the stopper base, and having a stopper body having a predetermined diameter, an insertion sleeve extended from a rear surface of the stopper body and having a prdetermined diameter and length, and an insertion protrusion protruded from a rear surface of the stopper body and having a predetermined length.

9. The structure according to claim 8 wherein the insertion sleeve is mounted on the sleeve mount hollow.

10. The structure according to claim 8, wherein the insertion protrusion is inserted into the protrusion insertion through-hole.

11. The structure according to claim 8, wherein the leg stopper has a plurality of radial reinforcing ribs on its rear surface, and the insertion protrusion is formed integrally with the reinforcing rib.

12. The structure according to claim 11, wherein the reinforcing rib comprises an inner rib provided inside of the insertion sleeve and an outer rib provided on a rear surface of the stopper body, the inner rib and the outer rib being provided on the same line.

13. The structure according to claim 8, further comprising at least one protrusion insertion through-hole being at a distance and provided inside of the stopper body.

14. The structure according to claim 13, wherein the protrusion insertion through-hole is provided on the same circumference as the insertion protrusion, and is spaced apart from the insertion protrusion in a circumferential direction.

* * * * *